US006576067B2

(12) United States Patent
Spitsberg et al.

(10) Patent No.: US 6,576,067 B2
(45) Date of Patent: Jun. 10, 2003

(54) FABRICATION OF AN ARTICLE HAVING A PROTECTIVE COATING WITH A POLISHED, PRE-OXIDIZED PROTECTIVE-COATING SURFACE

(75) Inventors: Irene Spitsberg, Loveland, OH (US); Ramgopal Darolia, West Chester, OH (US)

(73) Assignee: General Electric Co., Cincinnati, OH (US)

( * ) Notice: Subject to any disclaimer, the term of this patent is extended or adjusted under 35 U.S.C. 154(b) by 14 days.

(21) Appl. No.: 09/944,711

(22) Filed: Aug. 31, 2001

(65) Prior Publication Data

US 2003/0041928 A1 Mar. 6, 2003

(51) Int. Cl.[7] ..... C23C 8/80

(52) U.S. Cl. ..... 148/277; 148/285; 427/248.1; 427/250; 427/255.32

(58) Field of Search ..... 148/240, 277, 148/285; 427/248.1, 250, 255.32; 428/623, 469, 472.2

(56) References Cited

U.S. PATENT DOCUMENTS 4,414,249 A 11/1983 Ulion et al.
4,966,820 A 10/1990 Kojima et al.
5,238,752 A 8/1993 Duderstadt et al.
5,562,998 A 10/1996 Strangman
5,763,107 A 6/1998 Rickerby et al.
5,981,088 A 11/1999 Bruce et al.
6,123,997 A 9/2000 Schaeffer et al.

*Primary Examiner*—John Sheehan
*Assistant Examiner*—Andrew L. Oltmans

(57) ABSTRACT

An article protected by a thermal barrier coating system is fabricated by providing an article substrate having a substrate surface, and thereafter producing on the substrate surface a protective coating having a polished, pre-oxidized protective coating surface. The protective coating is produced by depositing the protective coating on the substrate surface, the protective coating having a protective coating surface, thereafter polishing the protective-coating surface, and thereafter controllably oxidizing the protective-coating surface. The protective-coating surface may optionally be controllably roughened by grit blasting after polishing and before controllably oxidizing. A thermal barrier coating may be deposited overlying the polished, pre-oxidized protective-coating surface.

16 Claims, 4 Drawing Sheets

FABRICATION OF AN ARTICLE HAVING A PROTECTIVE COATING WITH A POLISHED, PRE-OXIDIZED PROTECTIVE-COATING SURFACE

This invention relates to protective systems such as used to protect some components of gas turbine engines and, more particularly, to the treatment of the protective-coating surface.

BACKGROUND OF THE INVENTION

Higher operating temperatures for gas turbine engines are continuously sought in order to increase their efficiency. However, as operating temperatures increase, the high-temperature durability of the components of the engine must correspondingly increase. Significant advances in high-temperature capabilities have been achieved through the formulation of nickel- and cobalt-base superalloys. Nonetheless, when used to form components of the turbine, combustor and augmentor sections of a gas turbine engine, such alloys alone are often susceptible to damage by oxidation and hot corrosion attack and may not retain adequate mechanical properties. For this reason, these components are often protected by an environmental and/or thermal-insulating coating, the latter of which is termed a thermal barrier coating (TBC) system. Ceramic materials and particularly yttria-stabilized zirconia (YSZ) are widely employed as a thermal barrier coating (TBC), or topcoat, of TBC systems used on gas turbine engine components. The TBC employed in the highest-temperature regions of gas turbine engines is typically deposited by electron beam physical vapor deposition (EBPVD) techniques that yield a columnar grain structure that is able to expand and contract without causing damaging stresses that lead to spallation.

To be effective, TBC systems must have low thermal conductivity, strongly adhere to the article, and remain adherent throughout many heating and cooling cycles. The latter requirement is particularly demanding due to the different coefficients of thermal expansion between ceramic topcoat materials and the superalloy substrates they protect. To promote adhesion and extend the service life of a TBC system, an oxidation-resistant bond coat is usually employed. Bond coats are typically in the form of overlay coatings such as MCrAlX (where M is iron, cobalt, and/or nickel, and X is yttrium or another rare earth element), or diffusion aluminide coatings. A notable example of a diffusion aluminide bond coat contains platinum aluminide (NiPtAl) intermetallic. When a bond coat is applied, a zone of interdiffusion forms between the substrate and the bond coat. This zone is typically referred to as a diffusion zone. The diffusion zone beneath an overlay bond coat is typically much thinner than the diffusion zone beneath a diffusion bond coat.

During the deposition of the ceramic TBC and subsequent exposures to high temperatures, such as during engine service, bond coats of the type described above oxidize to form a tightly adherent alumina (aluminum oxide or $Al_2O_3$) layer or scale that protects the underlying structure from catastrophic oxidation and also adheres the TBC to the bond coat. The service life of a TBC system is typically limited by spallation at or near the interfaces of the alumina scale with the bond coat or with the TBC. The spallation is induced by thermal fatigue as the article substrate and the thermal barrier coating system are repeatedly heated and cooled during engine service.

There is a need for an understanding of the specific mechanisms that lead to the thermal fatigue failure of the protective system, and for structures that extend the life of the coating before the incidence of such failure. The present invention fulfills this need, and further provides related advantages.

BRIEF SUMMARY OF THE INVENTION

The present invention provides an approach for fabricating an article protected by a protective system, and articles protected by the protective system. The life of the protective system is extended under conditions of thermal fatigue by delaying the onset of the protective coating/alumina scale convolution failure mode and also by altering the bonding and growth behavior of the alumina scale. The present approach is applicable to environmental-coating protective systems where there is no thermal barrier coating present. However, it realizes its greatest advantages when used in thermal barrier coating systems where the protective coating is a bond coat and a ceramic thermal barrier coating overlies the bond coat.

A method of fabricating an article protected by a protective coating system comprises the steps of providing an article substrate having a substrate surface, and thereafter producing on the substrate surface a protective coating having a polished, pre-oxidized protective-coating surface. The step of producing the protective coating includes the steps of depositing a protective coating on the substrate surface, the protective coating having the protective-coating surface, thereafter polishing the protective-coating surface, and thereafter controllably oxidizing the protective-coating surface. Optionally but preferably, there may be an additional step, after the step of polishing and before the step of controllably oxidizing, of controllably roughening the protective-coating surface. The controlled roughening may be accomplished by any technique, but grit blasting with a fine grit media is preferred. Optionally but preferably, a thermal barrier coating is deposited overlying the polished, pre-oxidized protective-coating surface.

The article substrate preferably is a nickel-base superalloy, and most preferably is a component of a gas turbine engine. The bond coat is preferably a diffusion aluminide bond coat such as a platinum aluminide bond coat. Desirably, the step of polishing the protective-coating surface produces a protective-coating surface that is flattened such that an average grain boundary displacement height of the protective coating is less than about 3 micrometers, more preferably less than about 1 micrometer, even more preferably less than about 0.5 micrometer, and most preferably substantially zero, over at least about 40 percent of the grain boundaries of the protective coating but more preferably over the entire grain boundary of the protective coating. Additionally, it is preferred that at least about 40 percent, and more preferably all, of the surface of the protective coating is flattened to have a grain displacement height of less than about 3 micrometers, more preferably less than about 1 micrometer, even more preferably less than about 0.5 micrometer, and most preferably zero.

The step of controllably oxidizing the protective coating preferably includes the step of heating the protective coating in an atmosphere having a partial pressure of oxygen of from about $10^{-5}$ mbar to about $10^{3}$ mbar, more preferably from about $10^{-5}$ mbar to about $10^{-2}$ mbar, at an oxidizing temperature of from about 1800° F. to about 2100° F., and for a time of from about ½ hour to about 3 hours. Most preferably, the controlled oxidation is performed by heating the protective coating to a pre-oxidation temperature of from about 2000° F. to about 2100° F. in a heating time of not more than about 45 minutes, preferably from about 1 to about 45 minutes, and more preferably from about 15 to about 35 minutes, and thereafter holding at the pre-oxidation temperature for a time of from about ½ hour to about 3 hours, in an atmosphere having a partial pressure of oxygen of about $10^{-4}$ mbar.

The present approach addresses two major mechanisms of thermal fatigue failure in protective coating systems. The polishing of the protective-coating surface reduces the tendency of the protective coating to form the convolutions that lead to spalling of the alumina that forms on the protective-coating surface. The controlled oxidation of the protective-coating surface improves the bond strength between the protective coating and the alumina scale, and also reduces the growth rate of the alumina scale, so that the oxide reaches its critical thickness after longer times. By forming the alumina scale by a controlled oxidation, the slowly growing alumina scale places less stresses on the bond coat/alumina scale interface. As a result, failure of the protective coating system during thermal fatigue is delayed, improving its life. The optional roughening, as by fine grit blasting, of the protective-coating surface encourages the formation of alpha alumina as distinct from other forms of alumina in the controlled oxidation, and cleans the surface in preparation for the controlled oxidation. Care is taken in the roughening that overly large height displacement defects are not introduced into the surface of the protective coating that would negate the effects of the polishing.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
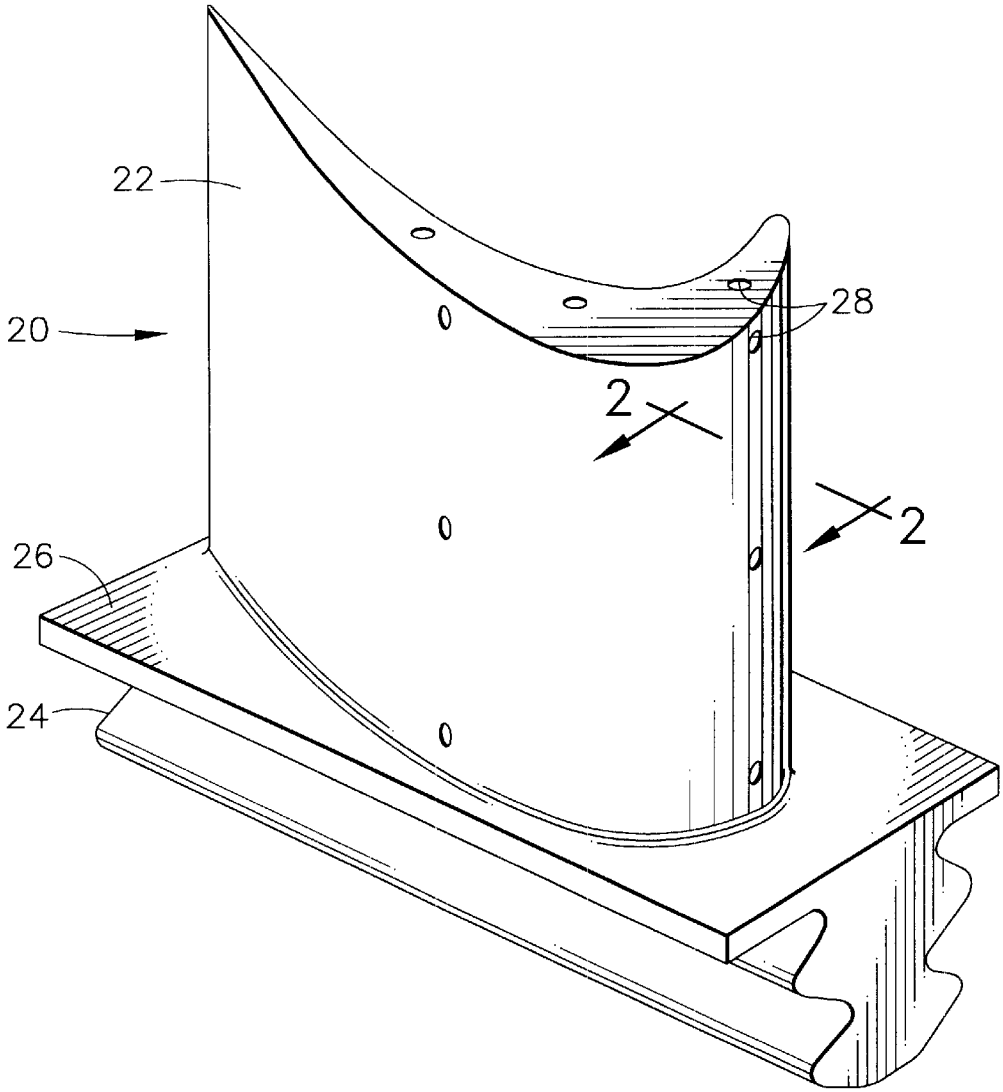
FIG. 1 is a perspective view of a turbine blade.

FIG. 1 depicts a component article of a gas turbine engine such as a turbine blade or turbine vane, and in this illustration a turbine blade 20. The turbine blade 20 is formed of any operable material, but is preferably a nickel-base superalloy. The turbine blade 20 includes an airfoil section 22 against which the flow of hot exhaust gas is directed. (The turbine vane or nozzle has a similar appearance in respect to the pertinent airfoil section, but typically includes other end structure to support the airfoil.) The turbine blade 20 is mounted to a turbine disk (not shown) by a dovetail 24 which extends downwardly from the airfoil 22 and engages a slot on the turbine disk. A platform 26 extends longitudinally outwardly from the area where the airfoil 22 is joined to the dovetail 24. A number of internal passages extend through the interior of the airfoil 22, ending in openings 28 in the surface of the airfoil 22. During service, a flow of cooling air is directed through the internal passages to reduce the temperature of the airfoil 22.

Figure 2:
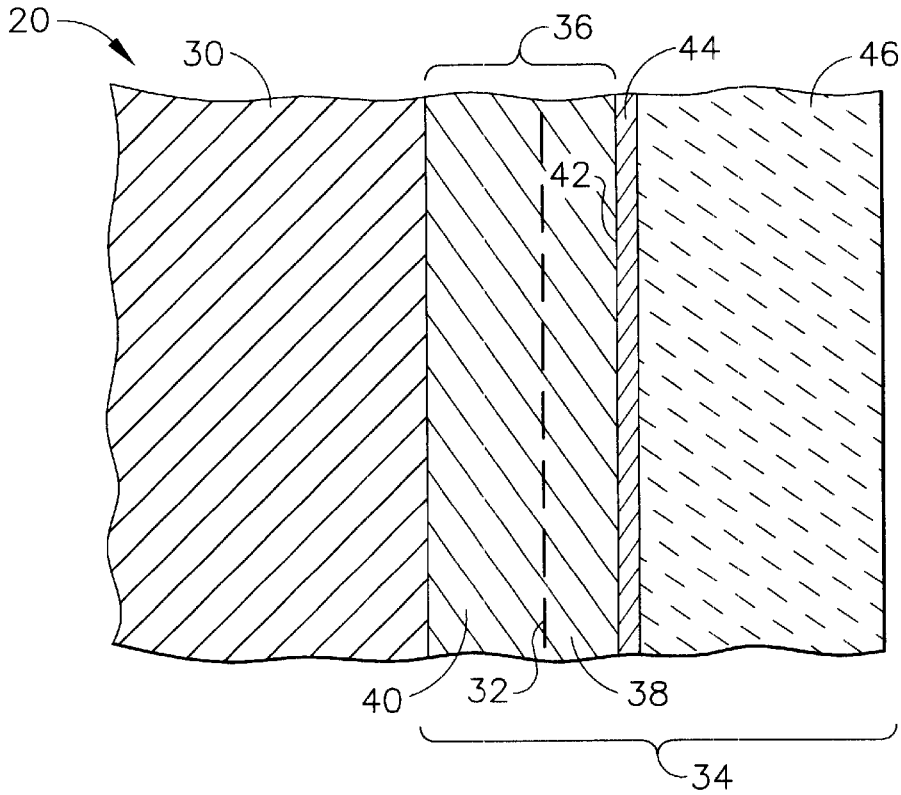
FIG. 2 is an enlarged schematic sectional view through the turbine blade of FIG. 1, taken on lines 2—2.

FIG. 2 is a schematic sectional view, not drawn to scale, through a portion of the turbine blade 20, here the airfoil section 22. The turbine blade 20 has a body that serves as a substrate 30 with a surface 32. Overlying and contacting the surface 32 of the substrate 30, and also extending downwardly into the substrate 30, is a protective coating system 34 including a protective coating 36. In the absence of an overlying ceramic thermal barrier coating, the protective coating 36 is termed an environmental coating. Where there is a thermal barrier coating, the protective coating 36 is termed a bond coat. The protective coating 36 includes a deposited layer 38 and a diffusion zone 40 that is the result of interdiffusion of material from the deposited layer 38 with material from the substrate 30. The process that deposits the deposited layer 38 onto the surface 32 of the substrate 30 is performed at elevated temperature, so that during deposition the material of the deposited layer 38 interdiffuses into and with the material of the substrate 30, forming the diffusion zone 40. The diffusion zone 40, indicated by a dashed line in FIG. 2, is a part of the protective coating 36 but extends downward into the substrate 30.

The protective coating 36 has an outwardly facing protective-coating surface 42 remote from the surface 32 of the substrate 30. An alumina (aluminum oxide, or $Al_2O_3$) scale 44 forms at this protective-coating surface 42 by oxidation of the aluminum in the protective coating 36 at the protective-coating surface 40. A ceramic thermal barrier coating 46 optionally overlies and contacts the protective-coating surface 42 and the alumina scale 44 thereon.

Figure 3:
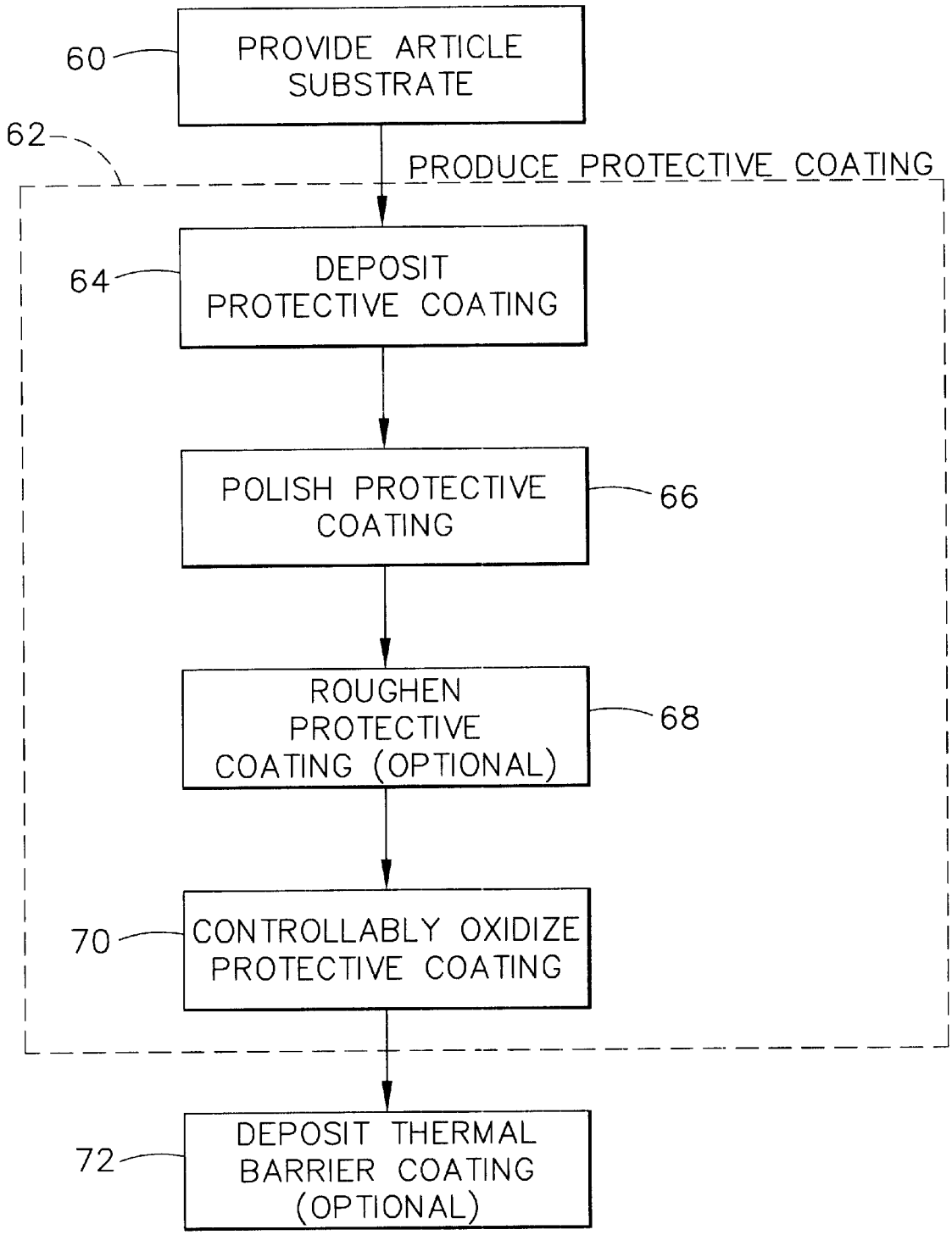
FIG. 3 is a block flow diagram of an approach for preparing a coated gas turbine airfoil.

FIG. 3 is a block flow diagram of a preferred approach for fabricating an article. An article and thence the substrate 30 are provided, numeral 60. The article is preferably a component of a gas turbine engine such as a gas turbine blade 20 or vane (or "nozzle", as the vane is sometimes called), see FIG. 1. The article is may be a single crystal article, a preferentially oriented polycrystal, or a randomly oriented polycrystal. The article is most preferably made of a nickel-base superalloy. As used herein, "nickel-base" means that the composition has more nickel present than any other element. The nickel-base superalloys are typically of a composition that is strengthened by the precipitation of gamma-prime phase. The preferred nickel-base alloy has a composition, in weight percent, of from about 4 to about 20 percent cobalt, from about 1 to about 10 percent chromium, from about 5 to about 7 percent aluminum, from 0 to about 2 percent molybdenum, from about 3 to about 8 percent tungsten, from about 4 to about 12 percent tantalum, from 0 to about 2 percent titanium, from 0 to about 8 percent rhenium, from 0 to about 6 percent ruthenium, from 0 to about 1 percent niobium, from 0 to about 0.1 percent carbon, from 0 to about 0.01 percent boron, from 0 to about 0.1 percent yttrium, from 0 to about 1.5 percent hafnium, balance nickel and incidental impurities.

A most preferred alloy composition is Rene' N5, which has a nominal composition in weight percent of about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, about 0.15 percent hafnium, up to about 0.01 percent yttrium, balance nickel and incidental impurities. Other operable superalloys include, for example, Rene' N6, which has a nominal composition in weight percent of about 12.5 percent cobalt, about 4.2 percent chromium, about 1.4 percent molybdenum, about 5.75 percent tungsten, about 5.4 percent rhenium, about 7.2 percent tantalum, about 5.75 percent aluminum, about 0.15 percent hafnium, about 0.05 percent carbon, about 0.004 percent boron, about 0.01 percent yttrium, balance nickel and incidental impurities; Rene 142, which has a nominal composition, in weight percent, of about 12 percent cobalt, about 6.8 percent chromium, about 1.5 percent molybdenum, about 4.9 percent tungsten, about 6.4 percent tantalum, about 6.2 percent aluminum, about 2.8 percent rhenium, about 1.5 percent hafnium, about 0.1 percent carbon, about 0.015 percent boron, balance nickel and incidental impurities; CMSX-4, which has a nominal composition in weight percent of about 9.60 percent cobalt, about 6.6 percent chromium, about 0.60 percent molybdenum, about 6.4 percent tungsten, about 3.0 percent rhenium, about 6.5 percent tantalum, about 5.6 percent aluminum, about 1.0 percent titanium, about 0.10 percent hafnium, balance nickel and incidental impurities; CMSX-10, which has a nominal composition in weight percent of about 7.00 percent cobalt, about 2.65 percent chromium, about 0.60 percent molybdenum, about 6.40 percent tungsten, about 5.50 percent rhenium, about 7.5 percent tantalum, about 5.80 percent aluminum, about 0.80 percent titanium, about 0.06 percent hafnium, about 0.4 percent niobium balance nickel and incidental impurities; PWA1480, which has a nominal composition in weight percent of about 5.00 percent cobalt, about 10.0 percent chromium, about 4.00 percent tungsten, about 12.0 percent tantalum, about 5.00 percent aluminum, about 1.5 percent titanium, balance nickel and incidental impurities; PWA1484, which has a nominal composition in weight percent of about 10.00 percent cobalt, about 5.00 percent chromium, about 2.00 percent molybdenum, about 6.00 percent tungsten, about 3.00 percent rhenium, about 8.70 percent tantalum, about 5.60 percent aluminum, about 0.10 percent hafnium, balance nickel and incidental impurities; and MX-4, which has a nominal composition as set forth in U.S. Pat. No. 5,482,789, in weight percent, of from about 0.4 to about 6.5 percent ruthenium, from about 4.5 to about 5.75 percent rhenium, from about 5.8 to about 10.7 percent tantalum, from about 4.25 to about 17.0 percent cobalt, from 0 to about 0.05 percent hafnium, from 0 to about 0.06 percent carbon, from 0 to about 0.01 percent boron, from 0 to about 0.02 percent yttrium, from about 0.9 to about 2.0 percent molybdenum, from about 1.25 to about 6.0 percent chromium, from 0 to about 1.0 percent niobium, from about 5.0 to about 6.6 percent aluminum, from 0 to about 1.0 percent titanium, from about 3.0 to about 7.5 percent tungsten, and wherein the sum of molybdenum plus chromium plus niobium is from about 2.15 to about 9.0 percent, and wherein the sum of aluminum plus titanium plus tungsten is from about 8.0 to about 15.1 percent, balance nickel and incidental impurities. The use of the present invention is not limited to these preferred alloys, and has broader applicability.

A polished, pre-oxidized protective coating 36 is produced on the surface 32 of the substrate 30, numeral 62. As part of this step 62, the protective coating 36 is deposited, numeral 64. The protective coating 36 is preferably a diffusion aluminide protective coating 36, produced by depositing an aluminum-containing layer onto the substrate 30 and interdiffusing the aluminum-containing layer with the substrate 30 to produce the deposited layer 38 and the diffusion zone 40 shown in FIG. 2. The protective coating 36 may be a simple diffusion aluminide, or it may be a more-complex diffusion aluminide wherein another layer, preferably platinum, is first deposited upon the surface 32, and the aluminum-containing layer is deposited over the first-deposited layer. In either case, the aluminum-containing layer may be doped with other elements that modify the protective coating 36. The basic application procedures for these various types of protective coatings 36 are known in the art, except for the modifications to the processing and structure discussed herein.

Because the platinum-aluminide is preferred as the protective coating 36, its deposition will be described in more detail. A platinum-containing layer is first deposited onto the surface 32 of the substrate 30. The platinum-containing layer is preferably deposited by electrodeposition. For the preferred platinum deposition, the deposition is accomplished by placing a platinum-containing solution into a deposition tank and depositing platinum from the solution onto the surface 32 of the substrate 30. An operable platinum-containing aqueous solution is $Pt(NH_3)_4HPO_4$ having a concentration of about 4–20 grams per liter of platinum, and the voltage/current source is operated at about ½–10 amperes per square foot of facing article surface. The platinum first coating layer, which is preferably from about 1 to about 6 micrometers thick and most preferably about 5 micrometers thick, is deposited in 1–4 hours at a temperature of 190–200° F.

A layer comprising aluminum and any modifying elements is deposited over the platinum-containing layer by any operable approach, with chemical vapor deposition preferred. In that approach, a hydrogen halide activator gas, such as hydrogen chloride, is contacted with aluminum metal or an aluminum alloy to form the corresponding aluminum halide gas. Halides of any modifying elements are formed by the same technique. The aluminum halide (or mixture of aluminum halide and halide of the modifying element, if any) contacts the platinum-containing layer that overlies the substrate 30, depositing the aluminum thereon. The deposition occurs at elevated temperature such as from about 1825° F. to about 1975° F. so that the deposited aluminum atoms interdiffuse into the substrate 30 during a 4 to 20 hour cycle.

The protective coating is polished, numeral 66, so as to flatten the protective-coating surface 42 by removal of metal. In this technique, the surface is polished so that a small amount of metal, typically about 2–4 micrometers depending upon the initial height of the vertical displacements on the surface, is removed from the surface 42 of the protective coating 36.

Figure 4:
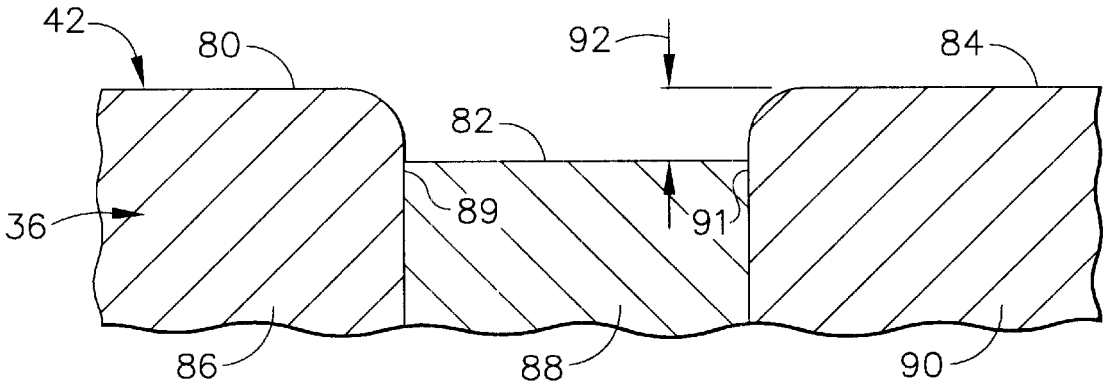
FIG. 4 is a schematic detail of the surface of the bond coat, taken in region 4 of FIG. 2 but without the alumina scale present, prior to polishing the surface.
Figure 5:
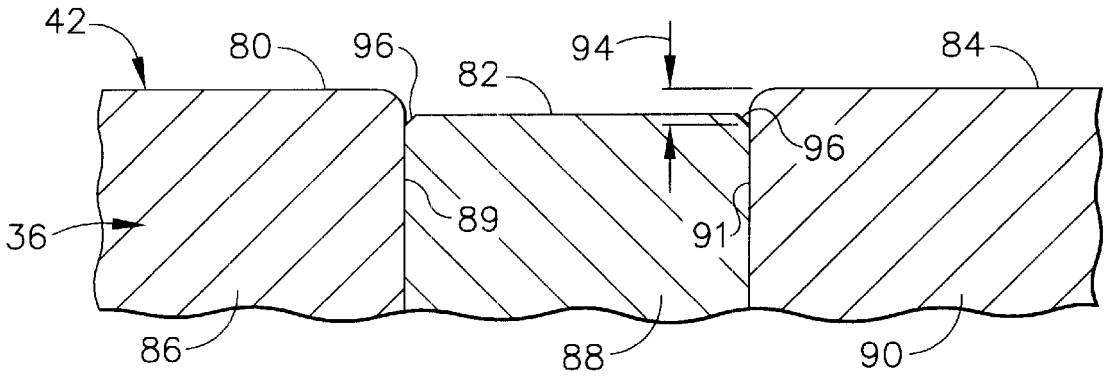
FIG. 5 is a schematic detail of the surface of the bond coat similar to that of FIG. 4, but after polishing of the surface.

FIGS. 4–5 illustrate the meaning of "flattening" and "polishing" as used herein. The surface 42 of the protective coating 36 is not perfectly flat when viewed at high magnification in a sectioning plane perpendicular to the surface 42. Instead, as seen in FIG. 4, there is a local maximum vertical displacement (i.e., perpendicular to the surface 42) between the points on the surfaces of adjacent pairs of grains at the grain boundaries. For example, in FIG. 4 there is a vertical displacement between respective surfaces 80 and 82 of neighboring grains 86 and 88 at a grain boundary 89, and another vertical displacement between respective surfaces 82 and 84 of neighboring grains 88 and 90 at a grain boundary 91. This vertical displacement is an initial grain boundary displacement height 92. The initial average magnitude of the grain boundary displacement height 92 for a diffusion aluminide protective coating is typically on the order of about 5 micrometers. This magnitude of the grain boundary displacement height leads to a failure mechanism of the alumina scale 44 during subsequent service termed ratcheting that produces convolutions in the alumina scale 44 in the neighborhood of the grain boundaries 89 and 91.

According to the present approach, the magnitude of the initial grain boundary displacement height 92 is reduced to a maximum final grain boundary displacement height 94 as illustrated in FIG. 5 by the polishing 66. There may be slight grooves 96 at the intersections of the grain boundaries 89 and 91 with the surface 42. The final grain boundary displacement height 94 is measured to the bottoms of the grooves 96, where present, or to the grain surface 82 where no grooves 96 are present. Where the surfaces 82 and 84 are at the same height and there is a groove 96 present, the grain boundary displacement height 94 is measured from the bottom of the groove 96 to either the surface 82 or the surface 84. Where the surfaces 82 and 84 are at the same height and there are no grooves 96 present, the grain boundary displacement height 94 is zero. The average final grain boundary displacement height 94 is less than about 3 micrometers, more preferably less than about 1 micrometer, more preferably less than about 0.5 micrometer, and most preferably substantially zero, to suppress the incidence of the convolution/ratcheting failure mechanism. Achieving these grain boundary displacement heights 94 over 40 percent or more of the grain boundaries results in improvement in the service life of the protective coating, although it is preferred that the indicated grain boundary displacement heights 94 are achieved over all of the grain boundaries. It is further preferred that at least about 40 percent, and more preferably all, of the surface of the protective coating has a grain displacement height of less than about 3 micrometers, more preferably less than about 1 micrometer, more preferably less than about 0.5 micrometer to suppress failure initiating at locations away from the grain boundaries.

The grain boundary displacement height is determined in an enlarged sectional view like that of FIG. 5, taken in a plane perpendicular to the protective-coating surface 42 and measured across the locations where grain boundaries in the protective coating 36 intersect the protective-coating surface 42. This reduction in the average grain boundary displacement height reduces the severity of, and extends the time of the onset of, the thermal cycling deformation convolution mechanism that leads to failure of the alumina scale 44.

The metal is not removed uniformly, but instead is preferentially removed from the highest displacements of the protective coating 36. The result is that the average grain boundary displacement height 94 is reduced. Polishing may be accomplished by any operable technique. The preferred approach is mechanical polishing. To demonstrate the operability of the process, specimens of nickel-base superalloy substrates with platinum aluminide protective coatings 36 were vibratory polished using a Syntron machine with a 400 gram load and a 1 rpm rotation speed. The result is a highly polished surface that may be mirror-like depending upon the extent of the polishing. In commercial practice with irregularly shaped articles, polishing may be accomplished, for example, by tumbling, vibrolapping, or electropolishing.

Optionally, as part of step 62, the protective-coating surface 42 may be controllably roughened, numeral 68, after the step of polishing 66 but before the step of controllably oxidizing. The controlled roughening 68 acts over the entire surface 42, although some areas may be roughened more than others. It is important that any such controlled roughening does not negate the effect of the prior polishing 66 by causing an unacceptable increase in the grain boundary displacement height 94 or by introducing new displacement defects elsewhere in the grains that are larger than about 3 micrometers (preferably about 1 micrometer, more preferably about 0.5 micrometer, most preferably substantially zero in height (measured perpendicular to the protective-coating surface 42). The controlled roughening 68 acts on the polished surface 42 to promote the subsequent formation of alpha-alumina as the scale 44, as distinct from other forms of alumina. The controlled roughening 68 also aids in cleaning any polishing or other residue from the surface 42 in preparation for the subsequent controlled oxidation.

Controlled roughening is preferably accomplished by fine grit blasting the protective-coating surface 42. The fine grit blasting preferably uses fine alumina grit having a grit classification of from about #320 to about #1200, most preferably about #600 grit. Coarser grit than #320 is not used, as a coarser grit may tend to introduce new displacement defects at the grain boundaries 91 or elsewhere on the surface 32 of the substrate 30 that are greater than the above-indicated displacement limits. The fine grit blasting uses a pressure of from about 30 to about 100 pounds per square inch, preferably from about 60 to about 80 pounds per square inch. Testing has shown that fine grit blasting with a #600 grit at 80 pounds per square inch does not introduce new height displacements at the grain boundaries 91 or elsewhere on the surface 80. It is preferred that at least about 40 percent, and more preferably all, of the surface of the protective coating has a grain displacement height of less than about 3 micrometers, more preferably less than about 1 micrometer, more preferably less than about 0.5 micrometer, and most preferably substantially zero, immediately prior to the controlled oxidizing step.

The protective-coating surface 42 is controllably oxidized to form the alumina scale 44, numeral 70. The parameters of the oxidation treatment are controlled to produce the desired thin, pure alumina scale 44. The controlled parameters include the partial pressure of oxygen, the temperature range of the pre-oxidation treatment 70, the heating rate to the pre-oxidation temperature, and the time of the pre-oxidation treatment.

To form the desired alumina scale 44, the partial pressure of oxygen is preferably between about $10^{-5}$ mbar (millibar) to about $10^{3}$ mbar, more preferably between about $10^{-5}$ mbar and about $10^{-2}$ mbar. Most preferably, the partial pressure of about $10^{-4}$ mbar, which produces the best thermal fatigue life in furnace cycle testing. The pre-oxidation step 70 is performed without combustion gas or other sources of corrosive agents present, which otherwise interfere with the formation of the desired high-purity alumina scale 44. The pre-oxidation temperature is preferably from about 1800° F. to about 2100° F., most preferably from about 2000° F. to about 2100° F. The higher pre-oxidation temperatures are preferred to favor the formation of alpha alumina, but the indicated maximum temperature may not be exceeded due to the potential for damage of the superalloy substrate. The article to be pre-oxidized is desirably heated from room temperature to the pre-oxidation temperature in about 45 minutes or less, more preferably from about 15 to about 35 minutes. If the heating is too slow, there is an opportunity for the formation of detrimental, less adherent, oxide phases within the alumina scale 44. The adherence of the alumina scale 44 to the protective coating is therefore reduced. The time at the pre-oxidizing temperature is preferably from about ½ hour to about 3 hours, to achieve a pure alumina scale 44 having a thickness of from about 0.1 micrometer to about 1 micrometer.

If the pre-oxidation parameters lie outside these ranges, an alumina scale will be produced, but it will be less desirable than the alumina scale 44 produced by pre-oxidation within these ranges. Comparative microanalysis (scanning electron microscope and XPS) of alumina scale produced using the indicated pre-oxidation parameters and alumina scale produced outside the indicated pre-oxidation parameters disclosed variations in the nature of the alumina scale. Non-uniform microstructures and finer alumina grain sizes resulted when the pre-oxidation pressure was greater than about $10^{-4}$ mbar. The non-uniformity increased when other elements than aluminum and oxygen were present in the alumina scale. Oxygen pressures within the range of from about $10^{-5}$ mbar to about $10^{3}$ mbar yielded desirable "ridge" type microstructures characteristic of alpha alumina when no elements other than aluminum and oxygen were present in the oxide. Low partial pressures of oxygen, below about $10^{-5}$ mbar, result in internal oxidation along with an outward diffusion of aluminum. Such a structure has reduced adhesion to the protective coating 36.

Optionally but preferably, the thermal barrier coating 46 is deposited overlying the polished and oxidized protective-coating surface 42 and the alumina scale 44 that has formed thereon, numeral 72. The optional ceramic thermal barrier coating 46, where present, is preferably from about 0.003 to about 0.010 inch thick, most preferably about 0.005 inch thick. The ceramic thermal barrier coating 46 is preferably yttria-stabilized zirconia, which is zirconium oxide containing from about 2 to about 12 weight percent, preferably from about 4 to about 8 weight percent, of yttrium oxide. Other operable ceramic materials may be used as well. The ceramic thermal barrier coating 46 may be deposited by any operable technique, such as electron beam physical vapor deposition or plasma spray.

The polishing and controlled oxidizing of the protective coating to produce the alumina scale 44 must be employed together in the present invention. The polishing of the protective-coating surface 42 reduces the tendency of the protective coating 36 to form the convolutions that lead to spalling of the alumina scale that forms on the protective-coating surface 42. The result is a postponement of the onset of the convolution failure mechanism, and an increased likelihood that failure will result from flat delamination of the thermally grown alumina scale 44 from the protective coating 36. The controlled oxidation of the protective-coating surface improves the bond strength between the protective coating and the alumina scale, and also slows the growth of the alumina scale. By forming the alumina scale by a controlled oxidation, the slow-growing alumina scale 44 is formed, which reduces stresses posed at the alumina scale 44/protective coating 36 interface. This, in turn, delays the start of the delamination failures. Thus, both mechanisms of failure are addressed and their tendency to cause early failure is suppressed. Suppressing only one of the failure mechanisms may have some beneficial effect, but not as much beneficial effect as when the two failure mechanisms are treated together as here.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method of fabricating an article protected by a thermal barrier coating system, comprising the steps of providing an article substrate having a substrate surface; and thereafter producing on the substrate surface a protective coating having a polished, pre-oxidized protective coating surface, the step of producing the protective coating including the steps of depositing the protective coating on the substrate surface, the protective coating having the protective coating surface, thereafter polishing the protective-coating surface, thereafter controllably roughening the protective-coating surface so as not to introduce surface defects having a displacement height of more than about 3 micrometers; and thereafter controllably oxidizing the protective-coating surface.

2. The method of claim 1, wherein the step of providing the article substrate includes the step of providing the article substrate comprising a nickel-base superalloy.

3. The method of claim 1, wherein the step of providing the article substrate includes the step of providing the article substrate comprising a component of a gas turbine engine.

4. The method of claim 1, wherein the step of depositing the protective coating includes the step of depositing a diffusion aluminide protective coating.

5. The method of claim 1, wherein the step of depositing the protective coating includes the step of depositing a platinum aluminide protective coating.

6. The method of claim 1, wherein the step of controllably roughening the protective-coating surface includes the step of fine grit blasting the protective coating surface using a grit size of from about #320 to about #1200 grit.

7. The method of claim 1, wherein the step of polishing the protective coating includes the step of polishing the protective-coating surface to a grain boundary displacement height of less than about 3 micrometers.

8. The method of claim 1, wherein the step of polishing the protective coating includes the step of polishing the protective coating by an approach selected from the group consisting of tumbling, vibrolapping, and electropolishing.

9. The method of claim 1, including an additional step, after the step of polishing, of depositing a thermal barrier coating overlying the polished, pre-oxidized protective-coating surface.

10. The method of claim 1, wherein the step of controllably oxidizing the protective-coating surface includes the step of heating the protective coating to an oxidizing temperature of from about 1800° F. to about 2100° F.

11. The method of claim 1, wherein the step of controllably oxidizing the protective-coating surface includes the step of heating the protective coating to an oxidizing temperature for a time of from about ½ to about 3 hours.

12. A method of fabricating an article protected by a thermal barrier coating system, comprising the steps of providing an article substrate having a substrate surface; and thereafter producing on the substrate surface a protective coating having a polished, pre-oxidized protective coating surface, the step of producing the protective coating including the steps of depositing the protective coating on the substrate surface, the protective coating having the protective coating surface, thereafter polishing the protective-coating surface, and thereafter controllably oxidizing the protective-coating surface, wherein the step of controllably oxidizing the protective-coating surface includes the step of heating the protective coating in an atmosphere having a partial pressure of oxygen of from about $10^{-5}$ mbar to about $10^{3}$ mbar.

13. The method of claim 12, wherein the step of controllably oxidizing the protective-coating surface includes the step of heating the protective coating in an atmosphere having a partial pressure of oxygen of from about $10^{-5}$ mbar to about $10^{-2}$ mbar.

14. The method of claim 12, wherein the step of controllably oxidizing the protective-coating surface includes the step of heating the protective coating in an atmosphere having a partial pressure of oxygen of about $10^{-4}$ mbar.

15. A method of fabricating an article protected by a thermal barrier coating system, comprising the steps of providing an nickel-base superalloy article substrate comprising a component of a gas turbine engine and having a substrate surface; thereafter producing on the substrate surface a polished, pre-oxidized platinum aluminide protective coating, the step of producing the polished, pre-oxidized platinum aluminide protective coating including the steps of depositing the protective coating on the substrate surface, the protective coating having a protective coating surface, thereafter polishing the protective-coating surface, thereafter controllably roughening the protective-coating surface so as not to introduce surface defects having a displacement height of more than about 3 micrometers, and thereafter controllably oxidizing the protective-coating surface; and depositing a thermal barrier coating overlying the polished, pre-oxidized protective-coating surface.

16. The method of claim 15, wherein the step of controllably roughening the protective-coating surface includes the step of fine grit blasting the protective coating surface using a grit size of from about #320 to about #1200 grit.

* * * * *